US005501280A

United States Patent [19]

Brisco

[11] Patent Number: 5,501,280

[45] Date of Patent: Mar. 26, 1996

[54] CASING FILLING AND CIRCULATING APPARATUS AND METHOD

[75] Inventor: David P. Brisco, Duncan, Okla.

[73] Assignee: Halliburton Company, Duncan, Okla.

[21] Appl. No.: 330,392

[22] Filed: Oct. 27, 1994

[51] Int. Cl.[6] ..... E21B 34/06

[52] U.S. Cl. ..... 166/373; 166/324; 166/326; 166/386; 166/387

[58] Field of Search ..... 166/380, 386, 166/387, 324, 373, 326

[56] References Cited

U.S. PATENT DOCUMENTS

| | | | |
|---|---|---|---|
| 2,280,785 | 4/1942 | Boynton | 166/11 |
| 3,811,499 | 5/1974 | Hutchison | 166/67 |
| 3,934,652 | 1/1976 | Cochran | 166/285 |
| 4,076,083 | 2/1978 | Sizer | 175/65 |
| 4,088,191 | 5/1978 | Hutchison | 166/223 |
| 4,100,968 | 7/1978 | Delano | 166/380 |
| 4,270,569 | 6/1981 | Reky et al. | 166/325 X |
| 4,522,430 | 6/1985 | Stromberg | 285/24 |
| 4,524,998 | 6/1985 | Brisco | 285/101 |
| 4,569,396 | 2/1986 | Brisco | 166/305.1 |
| 4,589,495 | 5/1986 | Langer et al. | 166/386 X |
| 4,718,495 | 1/1988 | Lubitz et al. | 166/387 |
| 4,791,992 | 12/1988 | Greenlee et al. | 166/387 |
| 4,817,724 | 4/1989 | Funderburg et al. | 166/337 |
| 4,961,465 | 10/1990 | Brandell | 166/184 |
| 4,997,042 | 3/1991 | Jordan et al. | 166/379 |
| 5,191,939 | 3/1993 | Stokley | 166/387 X |

*Primary Examiner*—Roger Schoeppel
*Attorney, Agent, or Firm*—Stephen R. Christian; C. Clark Dougherty, Jr.

[57] ABSTRACT

The present invention provides improved casing filling and circulating apparatus for running a casing string into a well bore using a drilling rig casing elevator and related equipment. The casing filling and circulating apparatus includes a flow passage therethrough and a check valve disposed within the flow passage for preventing spillage and for preventing fluid back-flow through the apparatus when the casing string is being lowered into a well bore. Additionally, the filling and circulating apparatus includes a pressure relief seal means which relieves pressure from the casing prior to when the filling and circulating apparatus is disconnected therefrom by back-flow through the apparatus thereby preventing spillage of fluid. Methods of using the casing filling and circulating apparatus are also provided.

20 Claims, 4 Drawing Sheets

CASING FILLING AND CIRCULATING APPARATUS AND METHOD

BACKGROUND OF THE INVENTION

1. Field of the Invention

The present invention relates to methods and apparatus for filling and circulating fluid through a well casing string as it is being run into a well bore, and preventing spillage of the fluid when casing joints are added to the string or the filling and circulating apparatus is otherwise removed from the casing string.

2. Description of the Prior Art

In the construction of oil and gas wells, a well bore is drilled into one or more subterranean formations or zones containing oil and/or gas to be produced. The well bore is typically drilled utilizing a drilling rig which has a rotary table on its floor to rotate a pipe string during drilling and other operations. The drilling rig may also have a top drive mechanism for rotating the pipe string which is integral with the traveling block of the rig in addition to or instead of a rotary table.

During a well bore drilling operation, drilling fluid (also called drilling mud) is circulated through the well bore by pumping it down the drill string, through the drill bit and upwardly back to the surface through the annulus between the walls of the well bore and the drill string. The circulation of the drilling fluid functions to lubricate the drill bit, remove cuttings from the well bore as they are produced and to exert hydrostatic pressure on pressurized fluid containing formations penetrated by the well bore whereby blow-outs are prevented.

In most instances, after the well bore is drilled, the drill string is removed therefrom and a string of casing is run thereinto while maintaining sufficient drilling fluid in the well bore to prevent blow-outs, etc. During casing running operations, i.e., the lowering of a casing string into the well bore, it is not uncommon for the casing string to become stuck in the well bore. In such instances, the casing is usually washed free by circulating a fluid, usually drilling fluid, down the casing and through the lower end thereof to wash sand or other debris away from the casing. Also, during casing running operations, the casing string must be kept filled with fluid to prevent excessive fluid pressure differentials across the casing string and to prevent blow-outs. Typically, fluid is added to the casing string after each additional casing joint is added to the string and the string is lowered into the well bore.

In order to fill the casing string with fluid as it is being lowered and to circulate fluid through the casing string when it becomes stuck, the upper end of the casing is sealed with a device for allowing fluid to be pumped into the casing string as it is being lowered or unstuck. An example of such a filling and circulating device is described in U.S. Pat. No. 4,997,042 issued on Mar. 5, 1991 to Jordan et al. While the Jordan et al. device and method for using the device may satisfactorily allow a casing string being run into a well bore to be filled with fluid and for the fluid to be circulated when required to prevent sticking, a problem encountered with the device and other heretofore developed and used casing filling and circulating devices involves the spillage of fluid. That is, each time a casing joint is added to the casing string, the filling and circulating device must be removed from the casing string and reinstalled in the top of the casing joint added thereto. Because the fluid pressure inside the casing string is often greater than the fluid pressure within the filling and circulating device, when the device is removed from the casing string the ensuing pressure release often causes fluid to be spilled on the rig floor which produces a safety hazard to rig personnel. The fluid pressure differential between the filling and circulating device and the casing string is brought about by a check valve included in the device to prevent back-flow of fluid as the casing string is lowered into the well bore.

Thus, there is a need for an improved casing filling and circulating apparatus and method of using the apparatus whereby a casing string can be efficiently made up and lowered into a well bore without spillage of fluid occurring.

SUMMARY OF THE INVENTION

The present invention provides an improved casing filling and circulating apparatus and method of utilizing such apparatus during the construction of a well which meet the above described need and overcome the shortcomings of the prior art. The improved casing filling and circulating apparatus of the invention which includes a fluid flow path therethrough comprises a fluid conducting connector for connecting the apparatus to a fluid discharge coupling attached to the traveling block, top drive or other similar drilling rig location. A tubular pressure relief seal body member is connected to the other end of the connector, and a pressure relief seal assembly is connected to the body member for relieving pressure from the casing by back-flow through the connector when the pressure in the casing is higher than the pressure in the connector. A tubular casing seal body member is connected to the pressure relief body member, and a casing seal assembly is connected to the exterior of the casing seal body member for sealingly engaging the interior of a casing joint when the filling and circulating apparatus is inserted thereinto and fluid is pumped through the apparatus. A check valve assembly for preventing spillage from the filling and circulating apparatus and for preventing fluid back-flow through the casing filling and circulating apparatus except when the pressure relief valve means permits such backflow is disposed within the casing seal body member. A tubular guide nose member for guiding the filling and circulating apparatus into the open end of a casing joint is also connected to the seal body member.

A method of using the improved casing filling and circulating apparatus of the present invention for running a casing string comprised of a plurality of casing joints into a well bore without spillage of fluid is also provided by the present invention.

It is, therefore, a general object of the present invention to provide an improved casing filling and circulating apparatus and method of using such apparatus.

A further object of the present invention is the provision of an improved casing filling and circulating apparatus and method for running a casing string into a well bore while preventing spillage of fluid when the filling and circulating apparatus is disconnected from the casing string.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

Figure 1:
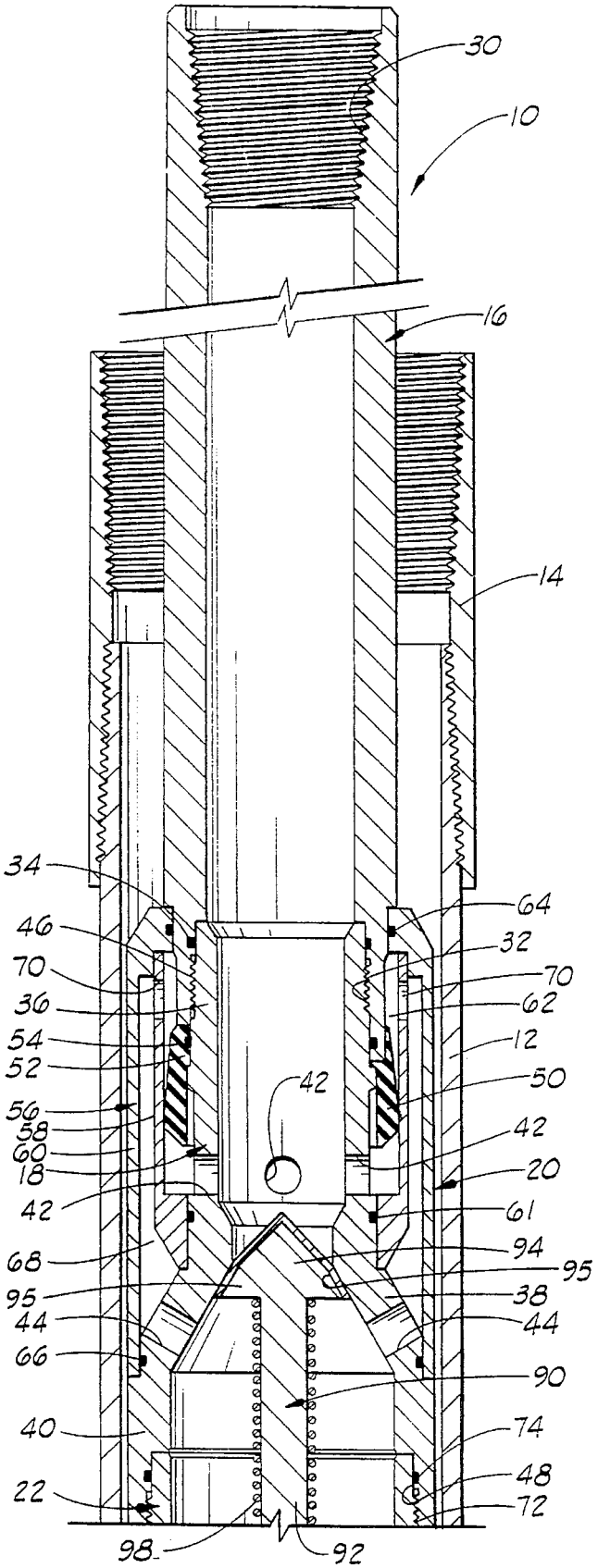
FIG. 1 is a side cross-sectional view of a top part of the improved casing filling and circulating tool of the present invention inserted in a casing string.
Figure 2:
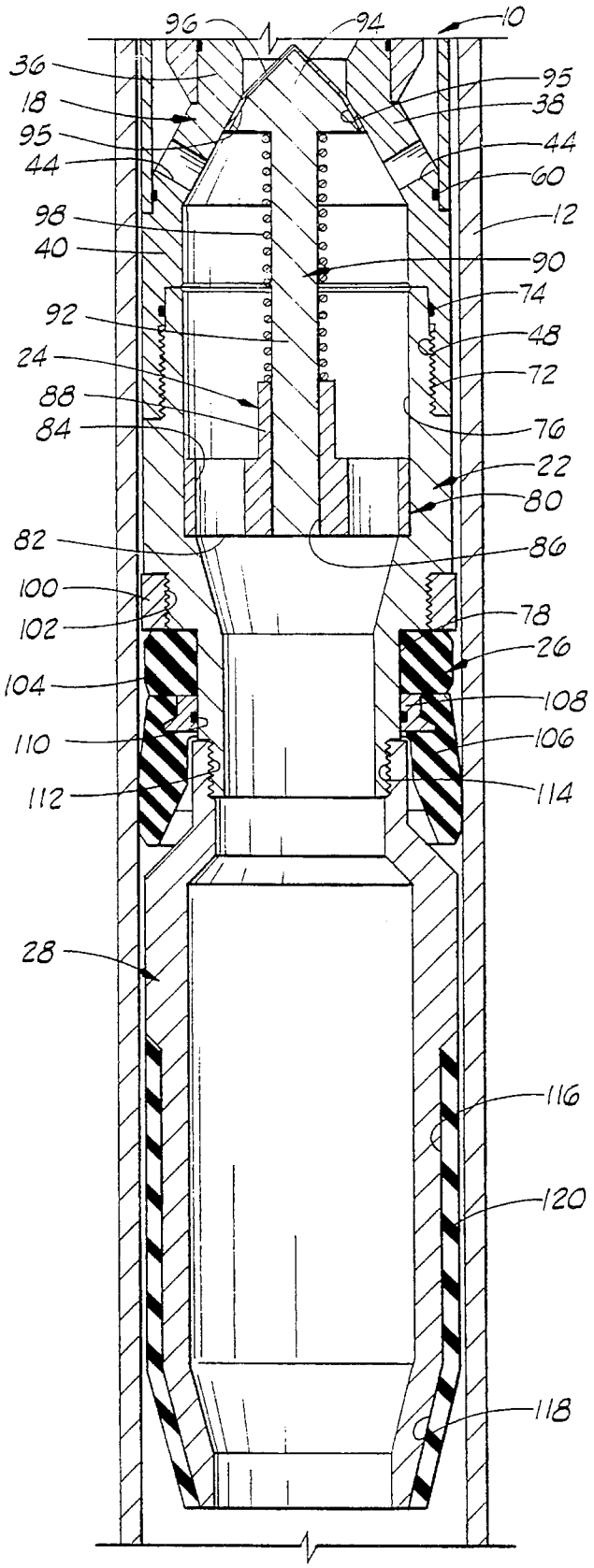
FIG. 2 is a side cross-sectional view of the bottom part of the tool of FIG. 1.

Referring now to the drawings, and particularly to FIGS. 1 and 2, the improved casing filling and circulating apparatus of the present invention is illustrated and generally designated by the numeral 10. The apparatus 10 is shown inserted into the top open end of a casing joint 12 having a casing collar 14 threadedly connected thereto which is a part of a casing string prior to introducing fluid into the casing string by way of the apparatus 10.

As shown, the filling and circulating apparatus 10 is comprised of a tubular fluid conducting connector 16, a tubular pressure relief seal body member 18 connected to the lower end of the connector 16, a pressure relief seal assembly 20 connected to the pressure relief seal body member 18, a tubular casing seal body member 22 connected to the pressure relief body member 20, a check valve assembly 24 connected to the interior of the casing seal body member 22, a casing seal assembly 26 connected to the exterior of the casing seal body member 22 and a tubular guide nose member 28 connected to the lower end of the casing seal body member 22.

As will be understood by those skilled in the art, the tubular connector 16 is threadedly connected at its top end to a fluid discharge coupling (not shown) which is attached to the traveling block or top drive of a drilling rig. A casing elevator (not shown) is also attached to the traveling block or top drive for removable attachment to a casing joint so that the casing joint can be connected to a casing string and the casing string can be lowered into the well bore, etc. Each time the elevators are connected to a casing joint, the filling and circulating apparatus 10 is inserted into the upper open end of the joint as illustrated in the drawings.

The elongated tubular connector 16 includes a first threaded bore 30 for releasably engaging the above mentioned fluid coupling, and a second threaded bore 32 for threadedly engaging the pressure relief seal body member 18. A conventional O-ring 34 is disposed between the connecting member 16 and the pressure relief seal body member 18 to prevent leakage therebetween.

The pressure relief seal body member 18 is comprised of an annular member having an upper cylindrical portion 36 connected to an enlarged lower cylindrical portion 40 by a tapered connecting portion 38. A plurality of lateral ports 42 are disposed in the upper cylindrical portion 36 of the body member 18, and a plurality of lateral ports 44 are disposed in the tapered connecting portion 38 thereof. The upper cylindrical portion 36 of the member 18 includes an external threaded portion 46 for connecting the body member 18 to the threaded bore 32 of the connector 16. As best shown in FIG. 2, the lower enlarged cylindrical portion 40 of the body member 18 includes an internal threaded bore 48 for connection to the casing seal body member 22.

Referring again to FIG. 1, the pressure relief seal assembly 20 connected to the pressure relief seal body 18 is comprised of a cup seal member 50 for providing a one way seal in an annular passageway and a housing, generally designated by the numeral 56, which will be described further hereinbelow. The cup seal member 50 is retained on the external surface of the cylindrical portion 36 of the body member 18 above the lateral ports 42 therein. The cup seal member 50 includes a back-up ring 52 which sealingly engages the external surface of the cylindrical portion 36 of the body member 18 by means of an O-ring seal 54 disposed in a groove in the back-up member 52.

The housing 56 of the pressure relief seal assembly 20 is comprised of an inner cylindrical wall 58 and an outer cylindrical wall 60. The inner cylindrical wall 58 is sealingly attached to the lower end of upper cylindrical portion 36 of the body member 18 below the lateral ports 42 therein. An O-ring seal 61 is disposed between the inner wall 58 and the body member 18 at the connection therebetween. As shown, the inner wall 58 forms an inner annular passageway 62 within which the cup seal member 50 is disposed. The outer wall 60 of the housing 56 is attached to the enlarged lower cylindrical portion 40 of the body member 18 at its lower end, to the upper end of the inner wall 58 and to a lower end portion of the connector 16. An O-ring seal 64 is disposed between the outer wall 60 and the connector 16, and an O-ring seal 66 is disposed between the outer wall 60 and the enlarged lower cylindrical portion 40 of the body member 18.

The outer wall 60 of the housing 56 forms a second annular passageway 68 between the inner and outer walls 58 and 60. The lateral ports 44 of the tapered connecting portion 38 of the body member 18 communicate with the annular passageway 68, and the inner wall 58 includes a plurality of lateral ports 70 disposed in the upper end portion thereof which communicate the annular passageway 62 containing the cup seal member 50 with the annular passageway 68. The lateral ports 42 in the upper cylindrical member 36 of the body member 18 communicate with the annular passageway 62.

Thus, as will be described further hereinbelow, the interior of the body member 18 below the valve 94 of the check valve assembly 24 is communicated with the annular passageway 68 by the ports 44. The annular passageway 68 is communicated with the annular passageway 62 by the ports 70 in the inner wall 58, and the annular passageway 62 is communicated with the interior of the upper cylindrical portion 36 of the body member 18 above the valve 94 of the check valve assembly 24 by the ports 42.

As best shown in FIG. 2, an upper threaded recessed portion of the casing seal body member 22 is threadedly connected to the threaded bore 48 of the pressure relief seal body member 18. An O-ring seal 74 is disposed between the body members 18 and 22. Referring specifically to FIG. 2, the casing seal body member 22 is comprised of a tubular member having an interior bore 76 for receiving the check valve assembly 24 and an exterior recessed surface 78 for receiving the casing seal assembly 26.

The check valve assembly 24 prevents spillage of fluid contained within the apparatus 10 above the valve of the assembly when the apparatus 10 is removed from the casing joint 12 and prevents fluid back-flow through the apparatus 10 except when the pressure relief valve assembly permits such back-flow. The check valve assembly 24 is comprised of a poppet valve support and guide member 80 having an annular cylindrical base 82 which includes a plurality of axial flow ports 84 therethrough. The base 82 also includes a central bore 86 disposed therein, and an integral cylindrical poppet valve guide 88 extends a distance upwardly from the top of the base 82.

A poppet valve 90 is provided which includes an elongated stem 92 slidably disposed within the central bore 86 of the support and guide member 80 and a valve 94 which is of a tapered shape such that it seats against the tapered inside surfaces 95 of the tapered connecting portion 38 of the body member 18. An elastomeric covering 96 is disposed on the upper surface of the valve 94 for insuring a fluid tight seal between the valve 94 and the surfaces 95 of the tapered connecting portion 38. A spring 98 is disposed around the stem 92 of the poppet valve 90 between the cylindrical portion 88 of the support and guide member 80 and the bottom of the valve 94. The spring 98 functions to bias the poppet valve 90 upwardly into sealing contact with the interior surfaces 95 of the connecting tapered portion 38 of the body member 18.

The casing seal assembly 26 is comprised of an annular centering member 100 retained on a recessed cylindrical surface 102 of the seal body member 22. An annular elastomeric back-up member 104 is retained on the recessed cylindrical surface 78 of the body member 22, and an annular elastomeric cup seal member 106 for sealing against the inside surfaces of the casing 12 is also retained on the surface 78 immediately below the back-up member 104. The cup seal member 106 includes a back-up ring 108 having an O-ring seal 110 disposed in a groove therein for preventing fluid leakage between the back-up ring 108 and the surface 78 of the body member 22.

The body member 22 includes a threaded recessed surface 112 at the bottom end thereof which is engaged with a complimentary threaded bore 114 at the top end of the guide nose member 28. The guide nose member 28 is an elongated tubular member having a cylindrical exterior surface 116 connected to a frusto conical surface 118 at the lower end thereof. The surfaces 116 and 118 are covered with an elastomeric covering 120.

OPERATION OF THE APPARATUS 10

Referring to FIGS. 1 and 2, the apparatus 10 is illustrated positioned in the top open end of the casing joint 12. The tubular connector 16 is threadedly connected at its top end to a fluid discharge coupling (not shown) which is attached to the traveling block or top drive of a drilling rig. Typically, the discharge coupling to which the connector 16 of the apparatus 10 is connected is communicated with the drilling rig drilling fluid pumps whereby drilling fluid can selectively be pumped through the flow passage in the apparatus 10 and into the casing string being lowered into a well bore. The apparatus 10 is connected to the fluid discharge coupling and is positioned with respect to a casing elevator (not shown) also attached to the traveling block or top drive whereby when the elevators are connected to a casing joint, the filling and circulating apparatus 10 is inserted into the upper open end of the joint as illustrated in the drawings. As long as the casing joint is attached to the drilling rig elevators, the filling and circulating apparatus 10 remains within the casing joint as illustrated in FIGS. 1 and 2. That is, the cup seal member 50 of the pressure relief seal assembly 20 is in a position whereby it contacts the cylindrical sides of the inner wall 58 and fluid is free to flow through the lateral ports 44, the passageways 68 and 62 formed by the housing 56 and the lateral ports 42, but not in the opposite direction. In a like manner, the cup seal 106 of the casing seal assembly 26 is positioned whereby it is in contact with the inside surfaces of the casing joint 12. Also, the poppet valve 90 of the check valve assembly 24 is in its uppermost position whereby the valve 94 is sealed against the internal surfaces 95 of the body member 18.

Figure 3:
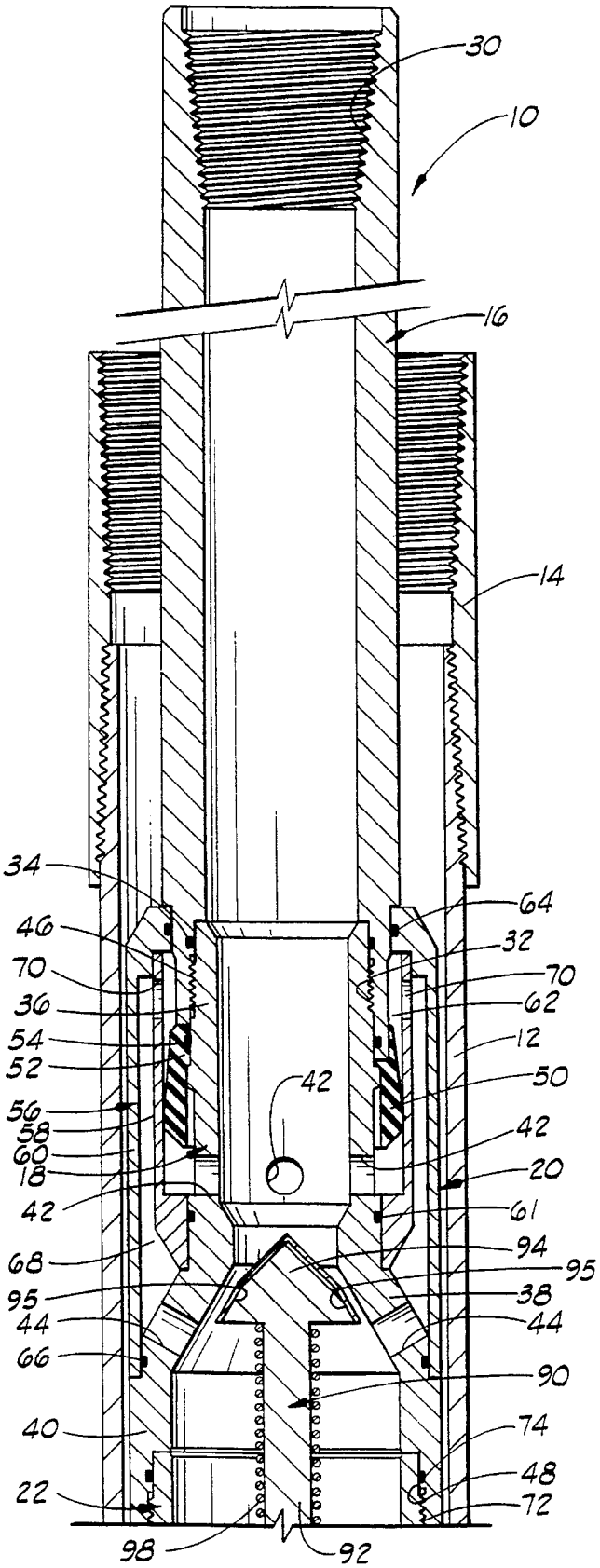
FIG. 3 is a side cross-sectional view of the top part of the tool of FIG. 1, but showing the tool during the pumping of drilling fluid therethrough.
Figure 4:
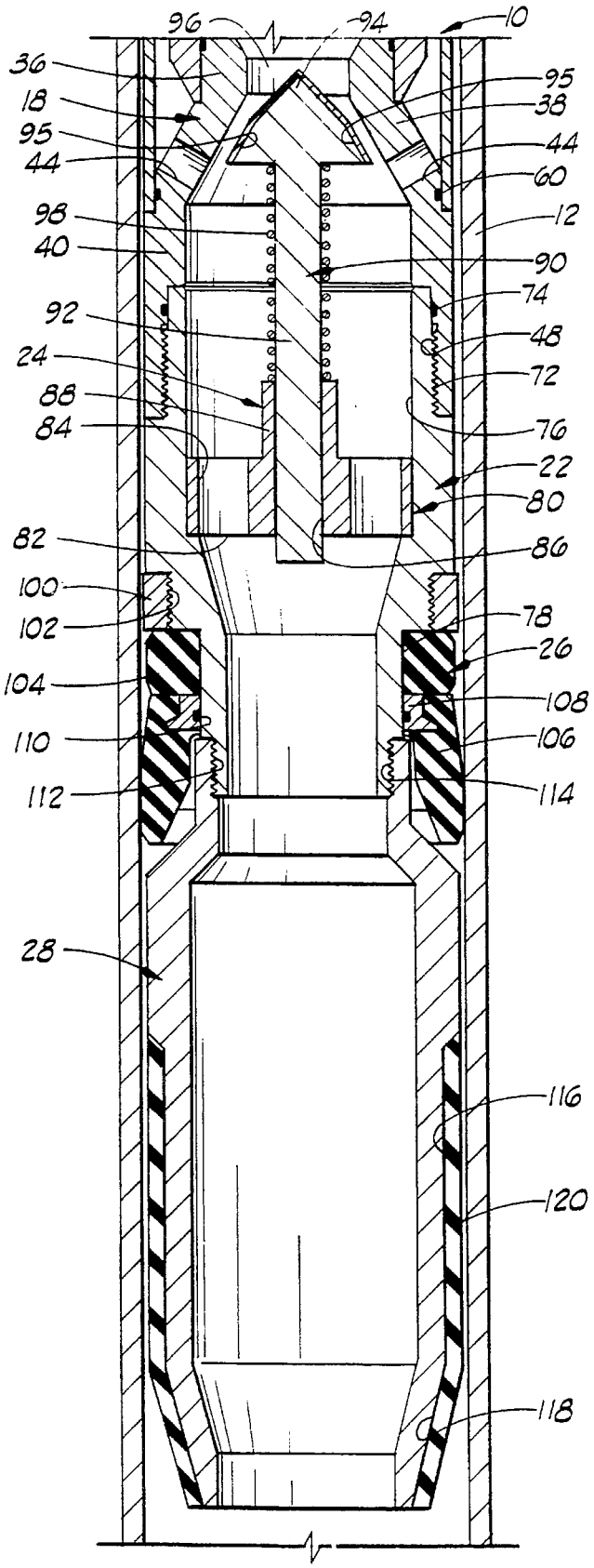
FIG. 4 is a side cross-sectional view of the bottom part of the tool of FIG. 3.

Referring now to FIGS. 3 and 4, when fluid is pumped into the filling and circulating apparatus 10, the fluid initially flows by way of the lateral ports 42 in the body member 18 into the passageway 62 but is prevented from flowing through the passageway 62 by the pressure relief cup seal member 50 which seals against the cylindrical sides of the inner wall 58. Fluid pressure is exerted against the valve 94 of the check valve assembly 24 which overcomes the resistance of the spring 98 and causes the poppet valve 92 to move downwardly as shown in FIGS. 3 and 4 whereby fluid flows through the filling and circulating apparatus 10 into the casing joint 12.

The cup seal member 106 of the casing seal assembly 26 which is in contact with the internal surfaces of the casing 12 seals the apparatus 10 within the casing joint 12 and prevents the upward flow of fluid around the apparatus 10.

When the flow of fluid through the filling and circulating apparatus 10 stops, the poppet valve 90 of the check valve assembly 24 moves upwardly into sealing engagement with the surfaces 95 by the spring 98 as illustrated in FIGS. 1 and 2. If the pressure within the casing 12 and the portion of the apparatus 10 below the valve 94 increases to a level greater than the pressure within the apparatus 10 above the valve 94, the pressure differential is relieved by back-flow through the connector 16 of the apparatus 10. That is, the pressure differential is communicated and fluid flow takes place from below the valve 94 to above the valve 94 by way of the lateral ports 44, through the passageways 62 and 68 of the housing 56, past the cup seal member 50 which readily moves out of contact with the cylindrical sides of the inner wall 58 and through the lateral ports 42 into the connector 16 of the apparatus 10. When the pressure differential is equalized by such back-flow, the elevators can be disconnected from the casing joint 12 and the apparatus 10 can be freely removed from the inside of the casing joint 12 without spillage of fluid due to pressure differential. The closed poppet valve 90 of the check valve assembly 24 prevents static fluid contained in the portion of the apparatus 10 above the valve 94 from flowing out of the apparatus 10 and spilling when the apparatus 10 is removed from the casing joint 12.

Thus, as will now be understood by those skilled in the art, the improved filling and circulating apparatus 10 of the present invention automatically functions to prevent fluid flow therethrough when it is not inserted in a casing joint, to seal itself within a casing joint, to prevent back-flow when the casing string is being lowered and fluid is being pumped thereinto and to allow back-flow when a reverse pressure differential is exerted on the apparatus 10, i.e., when the pressure within the casing is greater than the pressure within the connector 16 of the apparatus 10. Consequently, the filling and circulating apparatus 10 of this invention can be quickly and efficiently utilized for making up and lowering a casing string in a well bore without any form of manual manipulation of the apparatus to seal or unseal it being required and without the occurrence of fluid spillage.

Thus, the present invention is well adapted to carry out the objects and attain the ends and advantages mentioned as well as those which are inherent therein. While numerous changes in the construction and arrangement of parts may be made by those skilled in the art, such changes are encompassed within the spirit of this invention as defined by the appended claims.

What is claimed is:

1. An improved casing filling and circulating apparatus for running a casing string into a well bore comprising:

a tubular connector;

a tubular pressure relief seal body member connected to an end of said connector;

pressure relief seal means connected to said pressure relief seal body member for relieving pressure from said casing by back-flow through said connector when the pressure in said casing is higher than the pressure in said connector;

a tubular casing seal body member connected to said pressure relief seal body member;

check valve means connected to the interior of said casing seal body member for preventing spillage and for preventing fluid back-flow through said casing filling and circulating apparatus except when said pressure relief seal means permits such back flow;

casing seal means connected to the exterior of said casing seal body member for sealingly engaging the interior of said casing string when inserted thereinto; and a tubular guide nose member connected to said casing seal body member.

2. The apparatus of claim 1 wherein said connector is an elongated tubular member.

3. The apparatus of claim 1 wherein said tubular pressure relief seal body member has an upper cylindrical portion connected to an enlarged lower cylindrical portion by a tapered connecting portion, said upper cylindrical portion and said tapered connecting portion each including at least one lateral port disposed therein.

4. The apparatus of claim 3 wherein said pressure relief seal means comprise:

a cup seal member for providing a one way seal in an annular passageway attached to the exterior of said upper cylindrical portion of said pressure relief seal body member above said lateral port therein; and a housing sealingly attached to said pressure relief seal body member over said cup seal member and over said lateral ports therein, said housing forming an annular passageway containing said cup seal member and communicating said lateral ports in said pressure relief seal body member whereby when a pressure differential occurs in said annular passageway from said lateral port in said upper cylindrical portion of said pressure relief seal body member to said lateral port in said tapered connecting portion thereof, said cup seal member seals said passageway, and when a pressure differential occurs in the opposite direction, said cup seal member relieves said pressure differential and allows fluid flow through said passageway.

5. The apparatus of claim 3 wherein said tubular casing seal body member has an interior bore for receiving said check valve means and an exterior surface for receiving said casing seal means.

6. The apparatus of claim 5 wherein said check valve means comprise:

a poppet valve support and guide member disposed within said interior bore of said casing seal body member;

a poppet valve adapted to seal against the interior surfaces of said tapered connecting portion of said pressure relief seal body member above said lateral port therein slidably engaged with said support and guide member; and spring means for biasing said poppet valve towards said pressure relief seal body member disposed between said poppet valve and said support and guide member.

7. The apparatus of claim 5 wherein said casing seal means comprises:

an annular centering member retained on said exterior surface of said casing seal body member;

an annular elastomeric backup member retained on said exterior surface of said casing seal body member; and an annular elastomeric cup seal member for sealingly engaging said casing retained on said exterior surface of said casing seal body member.

8. An improved casing filling and circulating apparatus for running a casing string into a well bore comprising:

an elongated tubular fluid conducting connector;

a tubular pressure relief seal body member connected to an end of said tubular connector having an upper cylindrical portion connected to an elongated lower cylindrical portion by a tapered connecting portion, said upper cylindrical portion and said tapered connecting portion each including at least one lateral port disposed therein;

pressure relief seal means connected to said pressure relief seal body member for relieving pressure from said casing by back-flow through said connector when the pressure in said casing is higher than the pressure in said connector comprising, a cup seal member for providing a one way seal in an annular passageway attached to the exterior of said upper cylindrical portion of said pressure relief seal body member above said lateral port therein, and a housing sealingly attached to said seal body member over said cup seal member and over said lateral ports therein, said housing forming an annular passageway containing said cup seal member and communicating said lateral ports in said seal body member whereby when a pressure differential occurs from said lateral port in said upper cylindrical portion of said seal body member to said lateral port in said tapered connecting portion thereof, said cup seal member seals said passageway, and when a pressure differential occurs in the opposite direction, said cup seal member relieves said pressure differential and allows fluid flow through said passageway;

a tubular casing seal body member connected to said pressure relief body member having an interior bore for receiving a check valve means and an exterior surface for receiving a casing seal means;

check valve means disposed within the interior of said casing seal body member for preventing spillage and for preventing fluid back-flow through said casing filling and circulating apparatus except when said pressure relief valve assembly permits such back-flow comprising, a poppet valve support and guide member disposed within said interior bore of said casing seal body member, a popper valve adapted to seal against the interior surfaces of said tapered connecting portion of said pressure relief seal body member above said lateral port therein slidably engaged with said support and guide member, and spring means for biasing said popper valve towards said pressure relief seal body member disposed between said poppet valve and said support and guide member;

casing seal means connected to the exterior of said casing seal body member for sealingly engaging the interior of said casing string when inserted thereinto comprising, an annular centering member retained on said exterior surface of said casing seal body member, an annular elastomeric backup member retained on said exterior surface of said casing seal body member, and an annular elastomeric cup seal member for sealingly engaging said casing retained on said exterior surface of said casing seal body member; and a guide nose member connected to said casing seal body member.

9. The apparatus of claim 8 wherein said pressure relief seal body member includes a plurality of lateral ports in each of said upper cylindrical portion and said tapered connecting portion thereof.

10. The apparatus of claim 9 wherein said housing of said pressure relief seal means is cylindrical and includes inner and outer wall members which form connected annular passageways therein.

11. An improved method of filling and circulating fluid through a casing string comprised of a plurality of casing joints while running the casing string into a well bore and preventing spillage of the fluid when casing joints are added to the casing string comprising the steps of:

(a) providing a casing filling and circulating apparatus having a flow passage therethrough in fluid communication with fluid pumping equipment;

(b) inserting said filling and circulating apparatus into the uppermost end of the top casing joint of said casing string;

(c) pumping fluid through said flow passage of said filling and circulating apparatus and causing said apparatus to seal within said top casing joint whereby said casing is filled with fluid or fluid is circulated therethrough;

(d) discontinuing said pumping;

(e) preventing the back-flow of fluid through said flow passage of said filling and circulation apparatus while said casing string is lowered;

(f) causing pressurized fluid trapped within said casing string to be relieved therefrom whereby spillage of fluid is prevented when said filling and circulating apparatus is removed from said casing string; and (g) removing said filling and circulating apparatus from said casing string.

12. The method of claim 11 wherein said casing filling and circulating apparatus is caused to seal within said top casing joint of said casing string when fluid is pumped through said apparatus in accordance with step (c) by providing a casing seal means on an exterior surface of said apparatus positioned so that it is in sealing contact with said casing joint.

13. The method of claim 12 wherein said seal means comprises:

an annular centering member retained on said exterior surface of said apparatus;

an annular elastomeric backup member retained on said exterior surface of said apparatus; and an annular elastomeric cup seal member for sealingly engaging said casing retained on said exterior surface of said apparatus.

14. The method of claim 11 wherein back-flow of fluid through said filling and circulating apparatus is prevented in accordance with step (e) by providing a check valve means within said apparatus.

15. The method of claim 14 wherein said check valve means comprises:

a poppet valve support and guide member disposed within said flow passageway of said filling and circulating apparatus;

a poppet valve adapted to seal against interior surfaces of said filling and circulating apparatus slidably engaged with said support and guide member; and spring means for biasing said poppet valve towards said internal surfaces of said filling and circulating apparatus disposed between said poppet valve and said support and guide member.

16. The method of claim 11 wherein pressurized fluid trapped within said casing is caused to be relieved therefrom in accordance with step (f) by providing a pressure relief seal means within said filling and circulating apparatus which causes said pressurized fluid to be relieved from said casing by back-flow through said flow passage of said apparatus.

17. The method of claim 16 wherein said pressure relief seal means comprises:

a cup seal member for providing a one way seal in an annular passageway attached to said filling and circulating apparatus; and a housing sealingly attached to said filling and circulating apparatus over said cup seal member forming an annular passageway containing said cup seal member which communicates with said flow passage through said apparatus whereby when the fluid pressure in said filling and circulating apparatus is higher than the fluid pressure in said casing string said cup seal member prevents back-flow through said apparatus, but when the fluid pressure in said casing string is higher than the fluid pressure in said apparatus said cup seal member allows such back-flow.

18. The method of claim 11 wherein said casing filling and circulating apparatus is connected to the top drive of a top drive drilling rig.

19. The method of claim 11 wherein said fluid is drilling fluid.

20. The method of claim 19 wherein said drilling fluid is flowed through said flow passage of said filling and circulating apparatus by activating one or more drilling fluid pumps.

* * * * *